US010625980B2

(12) United States Patent
Matsueda et al.

(10) Patent No.: US 10,625,980 B2
(45) Date of Patent: Apr. 21, 2020

(54) ELEVATOR DEVICE THAT TRANSMITS INSPECTION DATA WHEN INSPECTION OPERATION AFTER EARTHQUAKE IS INTERRUPTED

(71) Applicant: Mitsubishi Electric Corporation, Chiyoda-ku (JP)

(72) Inventors: Yutaka Matsueda, Tokyo (JP); Akihiko Watanabe, Tokyo (JP); Norihiro Chotoku, Tokyo (JP); Masaki Hikichi, Tokyo (JP); Masafumi Etoh, Tokyo (JP); Masafumi Ozawa, Tokyo (JP); Takeshi Fujita, Tokyo (JP)

(73) Assignee: Misubishi Electric Corporation, Chiyoda-ku (JP)

( * ) Notice: Subject to any disclaimer, the term of this patent is extended or adjusted under 35 U.S.C. 154(b) by 338 days.

(21) Appl. No.: 15/559,713

(22) PCT Filed: Apr. 5, 2016

(86) PCT No.: PCT/JP2016/061165
§ 371 (c)(1),
(2) Date: Sep. 19, 2017

(87) PCT Pub. No.: WO2016/170974
PCT Pub. Date: Oct. 27, 2016

(65) Prior Publication Data

US 2018/0251337 A1 Sep. 6, 2018

(30) Foreign Application Priority Data

Apr. 20, 2015 (JP) ..... 2015-085910

(51) Int. Cl.
*B66B 5/02* (2006.01)
*B66B 5/00* (2006.01)
*B66B 1/34* (2006.01)

(52) U.S. Cl.
CPC ..... *B66B 5/022* (2013.01); *B66B 1/3423* (2013.01); *B66B 1/3453* (2013.01);
(Continued)

(58) Field of Classification Search
CPC ..... B66B 5/02; B66B 1/3423; B66B 1/3453; B66B 1/3461; B66B 5/00; B66B 5/022
(Continued)

(56) References Cited

U.S. PATENT DOCUMENTS 3,791,490 A * 2/1974 Smith ..... B66B 5/022 187/278
3,896,906 A * 7/1975 Shrum ..... B66B 5/022 187/278
(Continued)

FOREIGN PATENT DOCUMENTS

JP 02117579 A * 5/1990
JP 05139642 A * 6/1993
JP 2008-127141 A 6/2008

OTHER PUBLICATIONS

International Search Report dated Jun. 14, 2016 in PCT/JP2016/061165 filed Apr. 5, 2016.
(Continued)

*Primary Examiner* — Anthony J Salata
(74) *Attorney, Agent, or Firm* — Oblon, McClelland, Maier & Neustadt, L.L.P.

(57) ABSTRACT

An elevator device includes an operation control unit (18), a storage unit (22), a transmission unit (23), a determination unit (25), and a recovery unit (26). When an inspection operation is interrupted by the operation control unit (18), the transmission unit (23) transmits inspection data stored in the storage unit (22) to a plurality of specific devices (20). The determination unit (25) determines whether or not recovery conditions are satisfied on the basis of a plurality
(Continued)

No. 10: CONTROLLER
No. 11: COMMUNICATION DEVICE
No. 12: SEISMIC DETECTOR
No. 20: EXTERNAL DEVICE
No. 14: DISPLAY of responses from the devices (20) to which the transmission unit (23) transmits the inspection data. For example, the recovery unit (26) restores a normal operation when the determination unit (25) determines that the recovery conditions are satisfied.

16 Claims, 7 Drawing Sheets

(52) U.S. Cl.
CPC ..... *B66B 1/3461* (2013.01); *B66B 5/00* (2013.01); *B66B 5/02* (2013.01)

(58) Field of Classification Search
USPC ..... 187/247, 277, 278, 289, 293, 391, 393
See application file for complete search history.

(56) References Cited

U.S. PATENT DOCUMENTS 4,056,169 A * 11/1977 Showalter ..... B66B 5/022 187/278
4,809,817 A * 3/1989 Kawai ..... B66B 5/022 187/278
4,998,601 A * 3/1991 Suzuki ..... B66B 5/022 187/278
7,448,473 B2 * 11/2008 Lindberg ..... B66B 1/34 187/384
7,905,329 B2 * 3/2011 Urata ..... B66B 5/022 187/278
7,926,620 B2 * 4/2011 Amano ..... B66B 5/027 187/278
8,800,722 B2 * 8/2014 Kodera ..... B66B 5/022 187/278

OTHER PUBLICATIONS

International Preliminary Report on Patentability and Written Opinion dated Nov. 2, 2017 in PCT/JP2016/061165 (submitting English translation only).

* cited by examiner

No. 10: CONTROLLER
No. 11: COMMUNICATION DEVICE
No. 12 : SEISMIC DETECTOR
No. 20: EXTERNAL DEVICE
No. 14: DISPLAY

No. 17: LOAD WEIGHING DEVICE
No. 8 : ELECTRIC MOTOR
No. 9 : BRAKING DEVICE
No. 12: SEISMIC DETECTOR
No. 18: OPERATION CONTROL UNIT
No. 19: INSPECTION UNIT
No. 22: STORAGE UNIT
No. 23: TRANSMISSION UNIT
No. 24: RECEPTION UNIT
No. 25: DETERMINATION UNIT
No. 26: RECOVERY UNIT
No. 20: EXTERNAL DEVICE

S101: EARTHQUAKE EMERGENCY OPERATION
S102: START INSPECTION OPERATION
S103: ABNORMALITY DETECTED?
S104: INTERRUPT INSPECTION OPERATION
S105: TRANSMIT DATA
S106: RECOVERY CONDITIONS SATISFIED?
S107: RESTORE NORMAL OPERATION

S201: RECEIVED INSPECTION DATA?
S202: CONFIRM RESULT OF INSPECTION OPERATION AND CURRENT STATE OF ELEVATOR
S203: RESTORABLE WITHOUT INCIDENT?
S204: TRANSMIT PERMISSION FOR RESTORATION
S205: TRANSMIT NON-PERMISSION FOR RESTORATION

S401: RECEIVED STATE DATA?
S402: CONFIRM CURRENT STATE OF ELEVATOR
S403: CAN INSPECTION OPERATION BE STARTED WITHOUT INCIDENT?
S404: TRANSMIT PERMISSION FOR START
S405: TRANSMIT NON-PERMISSION FOR START

No. 10a: INPUT/OUPUT INTERFACE
No. 10b: PROCESSOR
No. 10c: MEMORY

No. 11a: INPUT/OUPUT INTERFACE
No. 11b: PROCESSOR
No. 11c: MEMORY

ELEVATOR DEVICE THAT TRANSMITS INSPECTION DATA WHEN INSPECTION OPERATION AFTER EARTHQUAKE IS INTERRUPTED

FIELD

The present invention relates to an elevator device and an elevator recovery method.

BACKGROUND

When an earthquake occurs, an elevator car stops. Conventionally, when a car is stopped by an earthquake, recovery of the elevator is performed after a professional technician performs an inspection on site.

Patent Literature 1 describes an elevator device which performs an inspection operation. The inspection operation is started after a car is stopped by an earthquake. When an abnormality is not detected in the inspection operation, the elevator is automatically restored to a normal operation.

CITATION LIST

Patent Literature

PTL 1: JP2008-127141A

SUMMARY

Technical Problem

The detection of an abnormality during the inspection operation causes the inspection operation to be interrupted. When the inspection operation is interrupted, a professional technician must be dispatched to the site. The technician performs an on-site inspection and, if an abnormality is not discovered, manually performs recovery of the elevator. When a major earthquake occurs, a large number of elevator cars are stopped at the same time. Since there is a limit to the number of technicians, a certain amount of time is required for the recovery of all elevators in a given area.

Even when a major earthquake occurs, the inspection operation is performed at a part of the elevator device. However, from a fail-safe perspective, the inspection operation is interrupted even when there is only a possibility that an abnormality has occurred. For example, the presence or absence of an abnormal sound may be determined during the inspection operation. In this case, if a microphone picks up the sound of a siren of an ambulance driving nearby, the inspection operation is interrupted. In particular, since response by technicians is delayed when a major earthquake occurs, there is a problem that a long period of time is required for recovery.

The present invention is made in order to solve the problem described above. An object of the present invention is to provide an elevator device and an elevator recovery method capable of reducing the time required for recovery in the event of an occurrence of a major earthquake or the like.

Solution to Problem

An elevator device of the present invention comprises operation control means for performing an inspection operation after an occurrence of an earthquake and interrupting the inspection operation when an abnormality is detected in inspection data, storage means for storing the inspection data collected during the inspection operation, transmission means for transmitting, when the inspection operation is interrupted by the operation control means, the inspection data stored in the storage means to a plurality of specific devices, determination means for determining whether or not recovery conditions are satisfied on the basis of a plurality of responses from the devices to which the transmission means transmits the inspection data, and recovery means for, when the determination means determines that the recovery conditions are satisfied, restoring a normal operation or causing the operation control means to restart the inspection operation.

An elevator device of the present invention comprises operation control means for performing an inspection operation after an occurrence of an earthquake and interrupting the inspection operation when an abnormality is detected in inspection data, storage means for storing the inspection data collected during the inspection operation, transmission means for transmitting, when the inspection operation is interrupted by the operation control means, the inspection data stored in the storage means to a transmission destination registered in advance in order to make the inspection data accessible from a plurality of specific devices or to transfer the inspection data to a plurality of specific devices, determination means for determining whether or not recovery conditions are satisfied on the basis of a plurality of responses from the devices with respect to the inspection data transmitted by the transmission means, and recovery means for, when the determination means determines that the recovery conditions are satisfied, restoring a normal operation or causing the operation control means to restart the inspection operation.

An elevator device of the present invention comprises operation control means for starting an inspection operation on the basis of state data after an occurrence of an earthquake, storage means for storing the state data collected after the occurrence of the earthquake, transmission means for transmitting, when the inspection operation is not started after the occurrence of the earthquake, the state data stored in the storage means to a plurality of specific devices, determination means for determining whether or not start conditions are satisfied on the basis of a plurality of responses from the devices to which the transmission means transmits the state data, and recovery means for, when the determination means determines that the start conditions are satisfied, causing the operation control means to start the inspection operation.

An elevator device of the present invention comprises operation control means for starting an inspection operation on the basis of state data after an occurrence of an earthquake, storage means for storing the state data collected after the occurrence of the earthquake, transmission means for transmitting, when the inspection operation is not started after the occurrence of the earthquake, the state data stored in the storage means to a transmission destination registered in advance in order to make the state data accessible from a plurality of specific devices or to transfer the state data to a plurality of specific devices, determination means for determining whether or not start conditions are satisfied on the basis of a plurality of responses from the devices with respect to the state data transmitted by the transmission means, and recovery means for, when the determination means determines that the start conditions are satisfied, causing the operation control means to start the inspection operation.

An elevator recovery method of the present invention comprises a step of performing an inspection operation after an occurrence of an earthquake and interrupting the inspection operation when an abnormality is detected in inspection data, a step of transmitting, when the inspection operation is interrupted, the inspection data collected during the inspection operation to a plurality of specific devices, a step of determining whether or not recovery conditions are satisfied on the basis of a plurality of responses from the devices to which the inspection data is transmitted, and a step of restoring a normal operation or causing the inspection operation to be restarted when the recovery conditions are determined to be satisfied.

An elevator recovery method of the present invention comprises a step of performing an inspection operation after an occurrence of an earthquake and interrupting the inspection operation when an abnormality is detected in inspection data, a step of transmitting, when the inspection operation is interrupted, the inspection data collected during the inspection operation to a transmission destination registered in advance in order to make the inspection data accessible from a plurality of specific devices or to transfer the inspection data to a plurality of specific devices, a step of determining whether or not recovery conditions are satisfied on the basis of a plurality of responses from the devices with respect to the inspection data, and a step of restoring a normal operation or causing the inspection operation to be restarted when the recovery conditions are determined to be satisfied.

An elevator recovery method of the present invention comprises a step of starting an inspection operation on the basis of state data after an occurrence of an earthquake, a step of transmitting, when the inspection operation is not started after the occurrence of the earthquake, the state data collected after the occurrence of the earthquake to a plurality of specific devices, a step of determining whether or not start conditions are satisfied on the basis of a plurality of responses from the devices to which the state data is transmitted, and a step of starting the inspection operation when the start conditions are determined to be satisfied.

An elevator recovery method of the present invention comprises a step of starting an inspection operation on the basis of state data after an occurrence of an earthquake, a step of transmitting, when the inspection operation is not started after the occurrence of the earthquake, the state data collected after the occurrence of the earthquake to a transmission destination registered in advance in order to make the state data accessible from a plurality of specific devices or to transfer the state data to a plurality of specific devices, a step of determining whether or not start conditions are satisfied on the basis of a plurality of responses from the devices with respect to the state data, and a step of starting the inspection operation when the start conditions are determined to be satisfied.

Advantageous Effects of Invention

According to the present invention, the time required for recovery can be reduced in the event of an occurrence of a major earthquake or the like.

DESCRIPTION OF EMBODIMENTS

Figure 1:
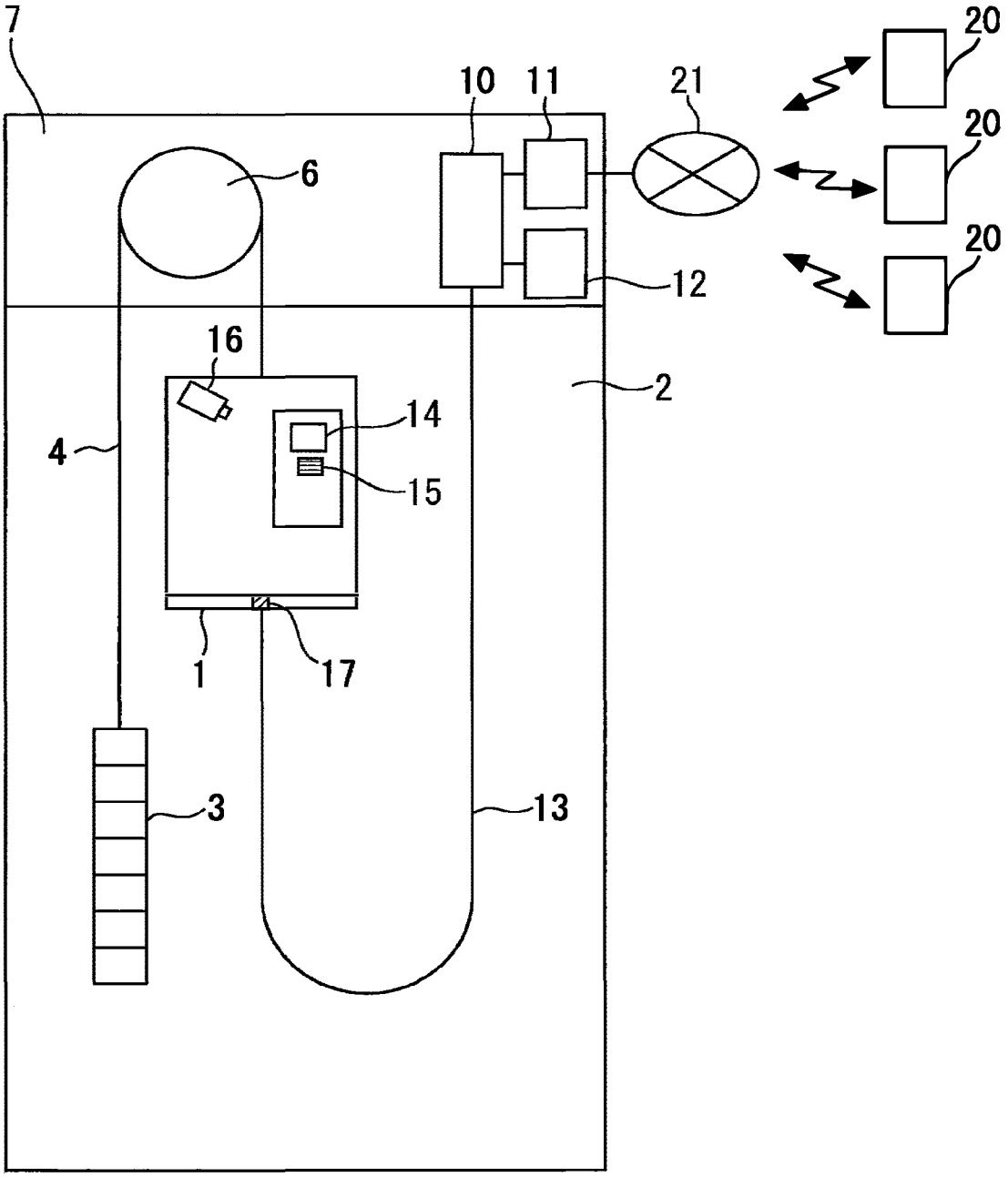
FIG. 1 is a diagram schematically showing an elevator device according to a first embodiment of the present invention.

The present invention will be described with reference to the accompanying drawings. Redundant descriptions will be simplified or omitted as appropriate. In each of the drawings, same reference numerals refer to same or corresponding parts.

First Embodiment

Figure 2:
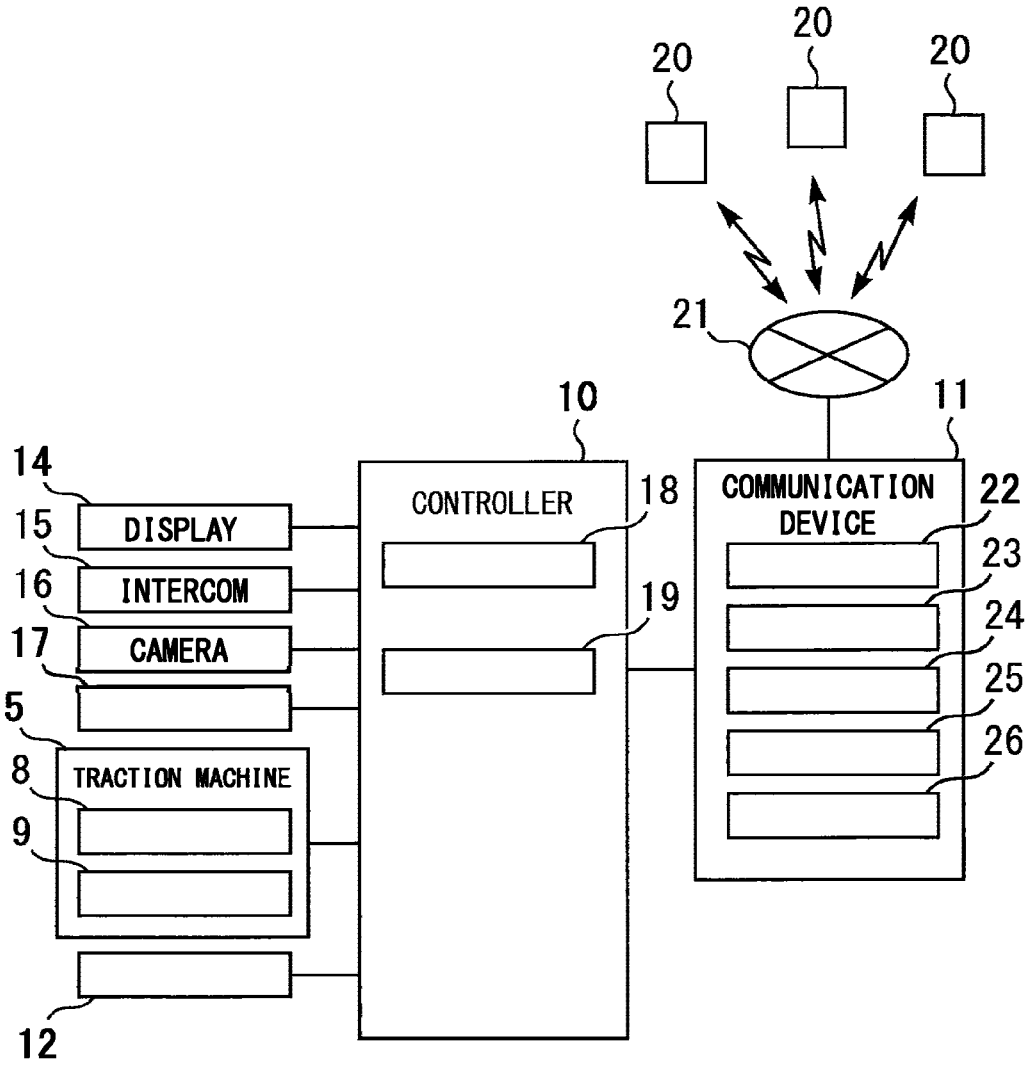
FIG. 2 is a diagram showing a configuration example of the elevator device according to the first embodiment of the present invention.

FIG. 1 is a diagram schematically showing an elevator device according to a first embodiment of the present invention. FIG. 2 is a diagram showing a configuration example of the elevator device according to the first embodiment of the present invention.

A car 1 of an elevator moves up and down in a shaft 2. A counterweight 3 moves up and down in the shaft 2 in an opposite direction to a direction of movement of the car 1. The car 1 and the counterweight 3 are suspended in the shaft 2 by a main rope 4. A roping system for suspending the car 1 is not limited to the example shown in FIG. 1. The main rope 4 is wound around a driving sheave 6 of a traction machine 5. When the driving sheave 6 rotates, the main rope 4 moves in a direction in accordance with a direction of rotation of the driving sheave 6. The car 1 ascends or descends due to a movement of the main rope 4 in a longitudinal direction.

FIG. 1 shows an example in which a machine room 7 is provided above the shaft 2. In the example shown in FIG. 1, the traction machine 5 is provided in the machine room 7. The traction machine 5 includes an electric motor 8 and a braking device 9 in addition to the driving sheave 6. The electric motor 8 rotates and stops the driving sheave 6. The braking device 9 holds the driving sheave 6 in a stationary state so as to prevent the driving sheave 6 from rotating.

In addition, a controller 10, a communication device 11, and a seismic detector 12 are provided in the machine room 7. The seismic detector 12 is connected to the controller 10. The seismic detector 12 detects an occurrence of an earthquake. The seismic detector 12 may detect an occurrence of an earthquake at a plurality of levels. The seismic detector 12 is constituted by, for example, an acceleration sensor. Upon detecting an occurrence of an earthquake, the seismic detector 12 outputs earthquake detection information to the controller 10.

The controller 10 controls operations of the elevator. The controller 10 is connected to the car 1 by a control cable 13.

Transmission and reception of information between the car 1 and the controller 10 are performed via the control cable 13. The car 1 includes, for example, a display 14, an intercom 15, a camera 16, and a load weighing device 17. For example, the controller 10 receives information from the intercom 15, information from the camera 16, and information from the load weighing device 17 via the control cable 13.

The display 14 is an example of a device for informing a passenger of information. The intercom 15 includes a microphone and a speaker. Voice information acquired by the microphone is output to the controller 10. The camera 16 photographs, for example, the inside of the car 1. Information on an image photographed by the camera 16 is output to the controller 10. The load weighing device 17 detects a car load of the car 1. FIG. 1 shows an example in which the car 1 includes the load weighing device 17. The load weighing device 17 may be provided at an end of the main rope 4. Information on a car load detected by the load weighing device 17 is output to the controller 10.

The controller 10 includes, for example, an operation control unit 18 and an inspection unit 19. The operation control unit 18 controls various operations. the operation control unit 18 controls, for example, a normal operation, an earthquake emergency operation, and an inspection operation.

The normal operation is an operation for transporting a passenger to a destination floor. In the normal operation, for example, the operation control unit 18 causes the car 1 to sequentially respond to registered calls.

The earthquake emergency operation is an operation performed when an earthquake occurs. For example, the operation control unit 18 starts the earthquake emergency operation when the seismic detector 12 detects an occurrence of an earthquake. During the earthquake emergency operation, for example, when a passenger is in the car 1, the operation control unit 18 stops the car 1 at a nearest floor. After stopping the car 1 at the nearest floor, the operation control unit 18 opens a door. The operation control unit 18 closes the door once a prescribed amount of time elapses after opening the door.

The inspection operation is an operation performed after an occurrence of an earthquake. When an earthquake occurs, the normal operation is stopped. The inspection operation is performed after the occurrence of the earthquake in order to automatically restore the normal operation. During the inspection operation, the inspection unit 19 detects an abnormality in inspection data.

Figure 7:
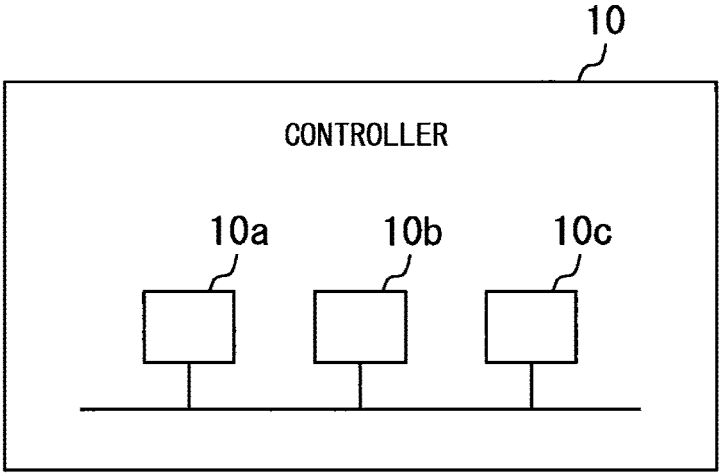
FIG. 7 is a diagram showing a hardware configuration of a controller.

The operation control unit 18 and the inspection unit 19 represent functions included in the controller 10. FIG. 7 is a diagram showing a hardware configuration of the controller 10. For example, as hardware resources, the controller 10 is provided with circuitry including an input/output interface 10*a*, a processor 10*b*, and a memory 10*c*. The controller 10 realizes each function of the operation control unit 18 and the inspection unit 19 by causing the processor 10*b* to execute a program stored in the memory 10*c*. The controller 10 may include a plurality of processors. The controller 10 may include a plurality of memories. In other words, a plurality of processors and a plurality of memories may cooperate with each other to realize each function of the operation control unit 18 and the inspection unit 19. Some or all functions of the operation control unit 18 and the inspection unit 19 may be realized by hardware.

The communication device 11 is a device used by the controller 10 to communicate with external devices 20. The communication device 11 is capable of communicating with the devices 20 via a communication line 21. The communication device 11 includes, for example, a storage unit 22, a transmission unit 23, a reception unit 24, a determination unit 25, and a recovery unit 26.

The transmission unit 23 transmits information from the elevator device to the outside. The storage unit 22 stores information to be transmitted by the transmission unit 23 to the outside. The reception unit 24 receives information from the outside. The storage unit 22 stores information received by the reception unit 24.

The determination unit 25 determines whether or not recovery conditions are satisfied. The recovery conditions are conditions for performing recovery of the elevator device. The recovery unit 26 restores a normal operation when the normal operation is stopped. In other words, the recovery unit 26 causes the operation control unit 18 to restart the normal operation. For example, the recovery unit 26 determines that the normal operation is to be restored when the determination unit 25 determines that the recovery conditions are satisfied.

Figure 8:
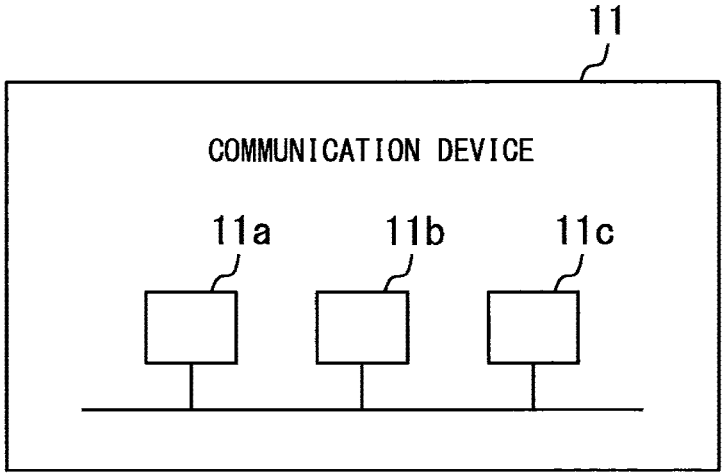
FIG. 8 is a diagram showing a hardware configuration of a communication device.

Each of the units denoted by reference numerals 22 to 26 represent a function included in the communication device 11. FIG. 8 is a diagram showing a hardware configuration of the communication device 11. For example, as hardware resources, the communication device 11 is provided with circuitry including an input/output interface 11*a*, a processor 11*b*, and a memory 11*c*. The communication device 11 realizes each function of the units 22 to 26 by causing the processor 11*b* to execute a program stored in the memory 11*c*. The communication device 11 may include a plurality of processors. The communication device 11 may include a plurality of memories. In other words, a plurality of processors and a plurality of memories may cooperate with each other to realize each function of the units 22 to 26. Some or all functions of the units 22 to 26 may be realized by hardware.

Figure 3:
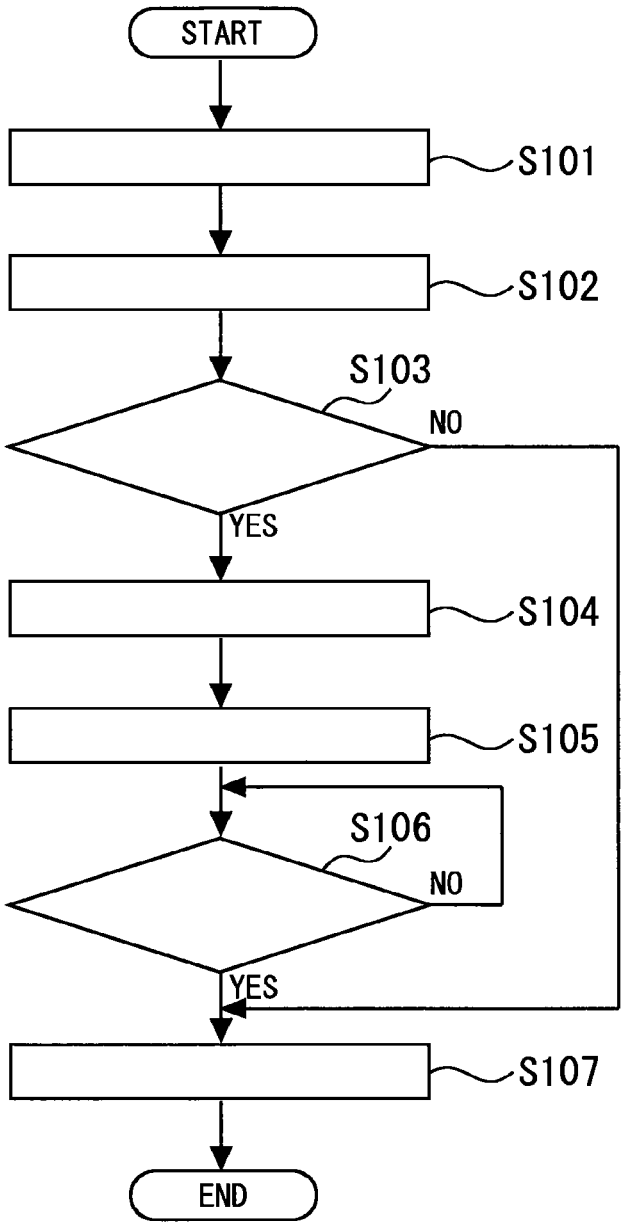
FIG. 3 is a flow chart showing an example of an operation of the elevator device according to the first embodiment of the present invention.

Next, an operation after an occurrence of an earthquake will be described by also referring to FIGS. 3 and 4. FIG. 3 is a flow chart showing an example of an operation of the elevator device according to the first embodiment of the present invention.

When an occurrence of an earthquake is detected by the seismic detector 12, earthquake detection information is transmitted from the seismic detector 12 to the controller 10. In the controller 10, upon receiving the earthquake detection information from the seismic detector 12, the operation control unit 18 stops a normal operation.

In a case where a passenger is in the car 1 when the normal operation is stopped, the operation control unit 18 starts an earthquake emergency operation (S101). Whether or not a passenger is in the car 1 is determined on the basis of, for example, car load information from the load weighing device 17. In the earthquake emergency operation, the operation control unit 18 stops the car 1 at a nearest floor. After stopping the car 1 at the nearest floor, the operation control unit 18 opens a door. The operation control unit 18 closes the door once a prescribed amount of time elapses after opening the door.

In the controller 10, after receiving the earthquake detection information from the seismic detector 12, the operation control unit 18 starts an inspection operation (S102). For example, the inspection operation is started after the earthquake emergency operation is finished. In a case where the earthquake emergency operation is not performed, for example, the inspection operation is started once a prescribed amount of time elapses after the occurrence of the earthquake.

In the inspection operation, the operation control unit 18 performs an operation determined in advance. While the operation by the operation control unit 18 is being performed, a variety of information is acquired as the inspection data. For example, the inspection data includes voice information acquired by the microphone, information on an image photographed by the camera 16, information on a car load detected by the load weighing device 17, and torque information from the electric motor 8. A part of the information exemplified above may be acquired as the inspection data. Information other than the information exemplified above may be acquired as the inspection data.

The inspection unit 19 determines whether or not there is an abnormality in the acquired inspection data (S103). The inspection unit 19 makes the determination by, for example, comparing the acquired inspection data with a reference value or a reference range. When the inspection unit 19 detects that there is an abnormality in the inspection data, the operation control unit 18 causes the inspection operation to be interrupted (S104). On the other hand, when the inspection operation is finished without detecting an abnormality in the inspection data, the normal operation is restored (S107).

The inspection data collected during the inspection operation is stored in the storage unit 22. When the inspection operation is interrupted by the operation control unit 18, the transmission unit 23 transmits the inspection data stored in the storage unit 22 to the external devices 20 (S105). For example, the inspection data transmitted by the transmission unit 23 to the devices 20 includes information determined as abnormal by the inspection unit 19. The transmission unit 23 transmits the inspection data to a plurality of devices 20 in S105. The devices 20 to which the transmission unit 23 transmits the inspection data are specified in advance.

The transmission unit 23 transmits the inspection data in S105 in order to have professional technicians review the inspection data collected during the inspection operation. Therefore, the devices 20 to which the transmission unit 23 transmits the inspection data are preferably mobile terminals of elevator maintenance workers who are professional technicians. In addition, when a major earthquake occurs, since the elevator maintenance workers responsible for an area of occurrence of the earthquake prioritize on-site work, even if the inspection data is sent to mobile terminals of the maintenance workers, the maintenance workers do not have time to view the data.

On the other hand, even when a major earthquake occurs, maintenance workers responsible for a remote area perform normal work. Therefore, the devices 20 to which the transmission unit 23 transmits the inspection data in S105 are preferably mobile terminals of maintenance workers responsible for a remote area. For example, when a major earthquake strikes the Kanto area and causes a large number of elevators to stop, maintenance workers responsible for the Kyushu area have enough time to view the sent inspection data. In consideration of requesting maintenance workers responsible for the Kansai area to view the inspection data when a major earthquake strikes the Kanto area, the remote area described above is favorably an area separated from an installation site of the elevator device by 300 km or more. Such a configuration also enables maintenance workers responsible for the Kanto area to check the inspection data when a major earthquake strikes the Kansai area.

Figure 4:
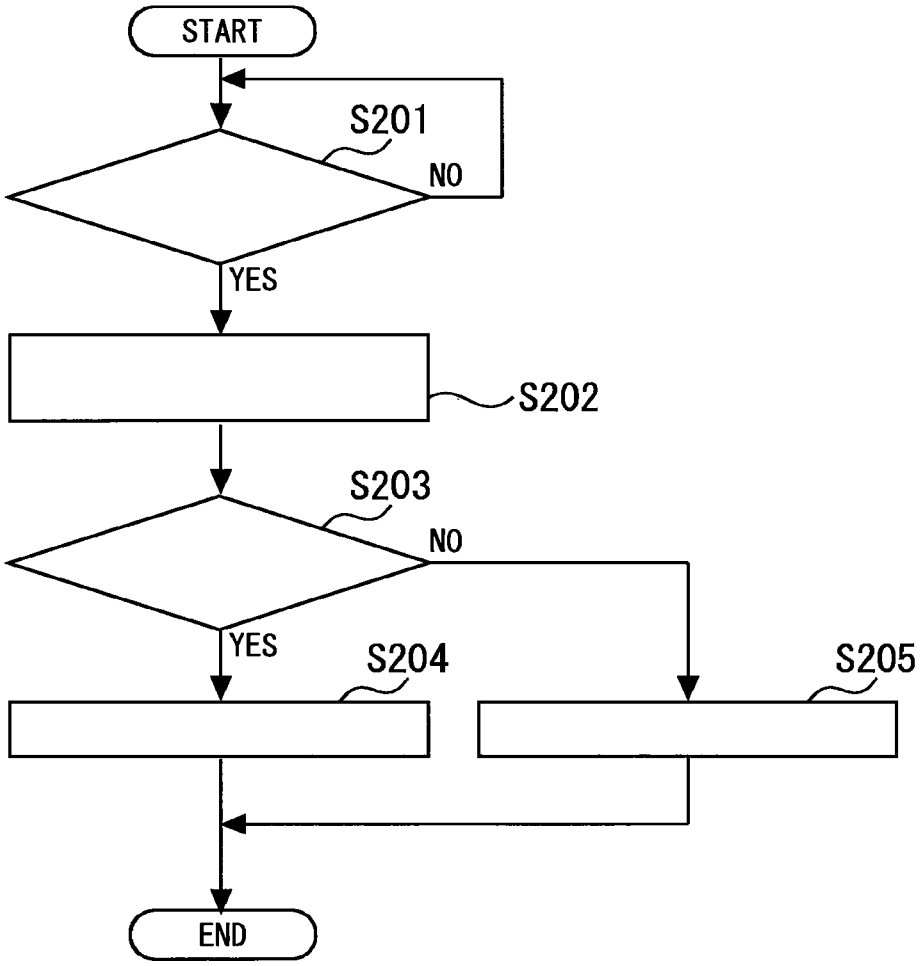
FIG. 4 is a flow chart for illustrating an operation example of an elevator maintenance worker responsible for a remote area.

FIG. 4 is a flow chart for illustrating an operation example of an elevator maintenance worker responsible for a remote area. In a mobile terminal (the device 20) owned by the maintenance worker, a determination is made on whether or not the inspection data has been received (S201). An elevator device to receive the inspection data is set in advance for each device 20. A plurality of elevator devices to receive the inspection data may be set for a single device 20. For example, when the inspection operation is interrupted in an elevator device A installed in the Kanto area, the inspection data is transmitted from the elevator device A to a mobile terminal of a maintenance worker B responsible for the Kyushu area.

Upon receiving the inspection data from an elevator device registered in advance, an owner of the device 20 confirms the received inspection data. For example, a result of the inspection operation and a current state of the elevator are confirmed by listening to voice information or viewing torque information (S202). When the maintenance worker having confirmed the inspection data determines that the elevator device may be restored to a normal operation without incident (Yes in S203), the maintenance worker transmits, from the device 20, information to the effect that restoration is to be permitted to the elevator device having transmitted the inspection data (S204). When the maintenance worker having confirmed the inspection data determines that restoring the elevator device to a normal operation may pose a problem (No in S203), the maintenance worker transmits, from the device 20, information to the effect that restoration is not to be permitted to the elevator device having transmitted the inspection data (S205).

The information transmitted from the device 20 in S204 or S205 is received by the reception unit 24 of the communication device 11. The transmission unit 23 has transmitted the inspection data to a plurality of devices 20 in S105. Therefore, the reception unit 24 receives responses from the plurality of devices 20. On the basis of the plurality of responses from the devices 20 received by the reception unit 24, the determination unit 25 determines whether or not recovery conditions are satisfied (S106). For example, the determination unit 25 determines that the recovery conditions are satisfied when information to the effect that restoration is to be permitted is received from all of the devices 20 to which the inspection data had been transmitted in S105. The determination unit 25 may determine whether or not the recovery conditions are satisfied on the basis of a proportion or the number of the devices 20 from which information to the effect that restoration is to be permitted is received.

The recovery unit 26 causes the operation control unit 18 to restore the normal operation when the determination unit 25 determines that the recovery conditions are satisfied (S107).

With an elevator device configured as described above, even when the inspection operation is interrupted, the elevator device can be restored to the normal operation on the basis of the determination by a plurality of professional technicians. For example, when the inspection operation is interrupted due to the microphone picking up a sound of a siren of an ambulance driving nearby, no problem would arise to restore the elevator device to the normal operation if there are no abnormalities in other inspection data. Therefore, the time required for recovery can be reduced. When a major earthquake occurs, it takes time for an elevator maintenance worker to arrive on site. Therefore, the elevator device configured as described above can be effective as means for swift recovery.

The configuration and operations of the elevator device disclosed in the present embodiment are merely examples. The elevator device may adopt the following configurations or operations. Alternatively, the elevator device may adopt a combination of the plurality of configurations and operations described below.

The storage unit 22, the determination unit 25, and the recovery unit 26 may be included in the controller 10.

In addition, the recovery unit 26 may cause the operation control unit 18 to restart the inspection operation when the determination unit 25 determines that the recovery conditions are satisfied. The recovery unit 26 may cause the normal operation to be restored or the inspection operation to be restarted when the determination unit 25 determines that the recovery conditions are satisfied. For example, when the inspection operation is interrupted immediately after the start of the inspection operation, it is more favorable to restart the inspection operation than to restore the normal operation. The recovery unit 26 may cause the normal operation to be restored or the inspection operation to be restarted in accordance with a cause of interruption of the inspection operation or a timing at which the inspection operation had been interrupted. When the inspection operation is restarted, the process of S102 is performed if a determination of Yes is made in S106.

In the present embodiment, an example has been described in which, when the inspection operation is interrupted, the inspection data stored in the storage unit 22 is directly transmitted to a plurality of external devices 20. When the inspection operation is interrupted, the transmission unit 23 may transmit the inspection data stored in the storage unit 22 to a specific transmission destination. The transmission destination to which the transmission unit 23 transmits the inspection data is registered in advance.

The transmission unit 23 transmits the inspection data in order to have a plurality of professional technicians review the inspection data collected during the inspection operation. Therefore, the inspection data may become accessible from a plurality of specific devices 20 when the transmission unit 23 transmits the inspection data to a transmission destination registered in advance. Alternatively, when the transmission unit 23 transmits the inspection data to a transmission destination registered in advance, the inspection data may be transferred to the plurality of specific devices 20 from the transmission destination.

The devices 20 from which the inspection data becomes accessible or the devices 20 to which the inspection data is transferred are preferably mobile terminals of elevator maintenance workers who are professional technicians. In addition, the devices 20 are preferably mobile terminals of maintenance workers responsible for a remote area. For example, the remote area is desirably an area separated from an installation site of the elevator device by 300 km or more.

The determination unit 25 determines whether or not the recovery conditions are satisfied on the basis of a plurality of responses from the devices 20 with respect to the inspection data transmitted by the transmission unit 23. For example, the determination unit 25 determines that the recovery conditions are satisfied when a determination to the effect that restoration is to be permitted is made by all of the devices 20 registered in advance as devices 20 to confirm the inspection data. The determination unit 25 may determine whether or not the recovery conditions are satisfied on the basis of a proportion or the number of the devices 20 having determined that restoration is to be permitted. The recovery unit 26 causes the operation control unit 18 to restore the normal operation when the determination unit 25 determines that the recovery conditions are satisfied.

By adopting the configuration described above, for example, a social networking service (SNS) or the like can be utilized for the recovery of an elevator device. Functions of an SNS often remain enabled even when an earthquake occurs. Therefore, an SNS can be effective means when a major earthquake occurs.

Second Embodiment

In the first embodiment, an example in which the inspection operation is interrupted has been described. In the present embodiment, an example in which the inspection operation is not started will be described. A configuration of an elevator device according to the present embodiment is the same as the configuration shown in FIGS. 1 and 2.

Figure 5:
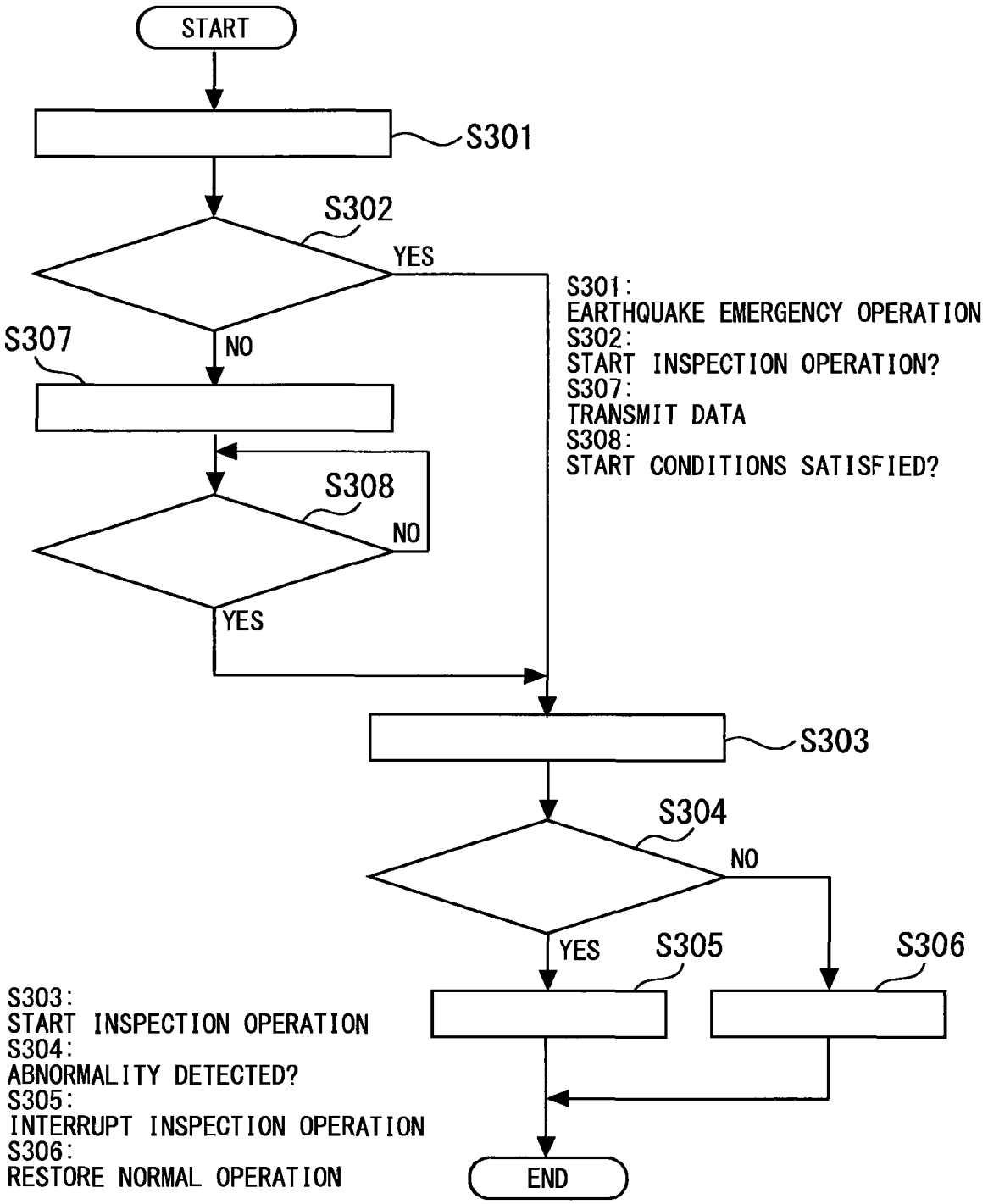
FIG. 5 is a flow chart showing an example of an operation of the elevator device according to a second embodiment of the present invention.

Hereinafter, an operation after an earthquake occurs will be described by also referring to FIGS. 5 and 6. FIG. 5 is a flow chart showing an example of an operation of the elevator device according to the second embodiment of the present invention.

The process of S301 is similar to the process of S101. After receiving earthquake detection information from the seismic detector 12, a determination is made on whether or not the inspection operation is to be started (S302). For example, the determination of S302 is made after the earthquake emergency operation is finished. When the earthquake emergency operation is not performed, for example, the determination of S302 is made once a prescribed amount of time elapses after the occurrence of the earthquake.

The operation control unit 18 starts the inspection operation on the basis of data representing a state of the elevator (hereinafter, referred to as "state data"). After the occurrence of an earthquake, a variety of information is acquired as the state data. For example, the state data includes information on a car load detected by the load weighing device 17, information representing an open or closed state of the door, and information representing a state of operation of a safety device. A part of the information exemplified above may be adopted as the state data. Information other than the information exemplified above may be adopted as the state data.

For example, when it is detected that a passenger is in the car 1, the inspection operation is not started (No in S302). As another example, when it is detected that the safety device has operated, the inspection operation is not started (No in S302). When a state in which the inspection operation cannot be performed is not detected (Yes in S302), the operation control unit 18 starts the inspection operation (S303).

The processes of S304, S305, and S306 are similar to the processes of S103, S104, and S107, respectively. The inspection unit 19 determines whether or not there is an abnormality in the acquired inspection data (S304). When the inspection unit 19 detects that there is an abnormality in the inspection data, the operation control unit 18 causes the inspection operation to be interrupted (S305). When the inspection operation is finished without detecting an abnormality in the inspection data, the normal operation is restored (S306). Processes similar to each process of S105 and S106 may be performed after the inspection operation is interrupted in S305.

The state data collected after the occurrence of an earthquake is stored in the storage unit 22. When it is determined in S302 that the inspection operation is not to be started, the transmission unit 23 transmits the state data stored in the storage unit 22 to the external devices 20 (S307). For example, the state data transmitted by the transmission unit 23 to the devices 20 includes information having caused the determination of not starting the inspection operation to be made. The transmission unit 23 transmits the state data to a plurality of devices 20 in S307. The devices 20 to which the transmission unit 23 transmits the state data are specified in advance.

The transmission unit 23 transmits the state data in S307 in order to have professional technicians review the state data collected after the occurrence of an earthquake. Therefore, the devices 20 to which the transmission unit 23 transmits the state data are preferably mobile terminals of elevator maintenance workers who are professional technicians. In addition, for a similar reason to that described in the first embodiment, the devices 20 to which the transmission unit 23 transmits the state data are preferably mobile terminals of maintenance workers responsible for a remote area. For example, the remote area is desirably an area separated from an installation site of the elevator device by 300 km or more.

Figure 6:
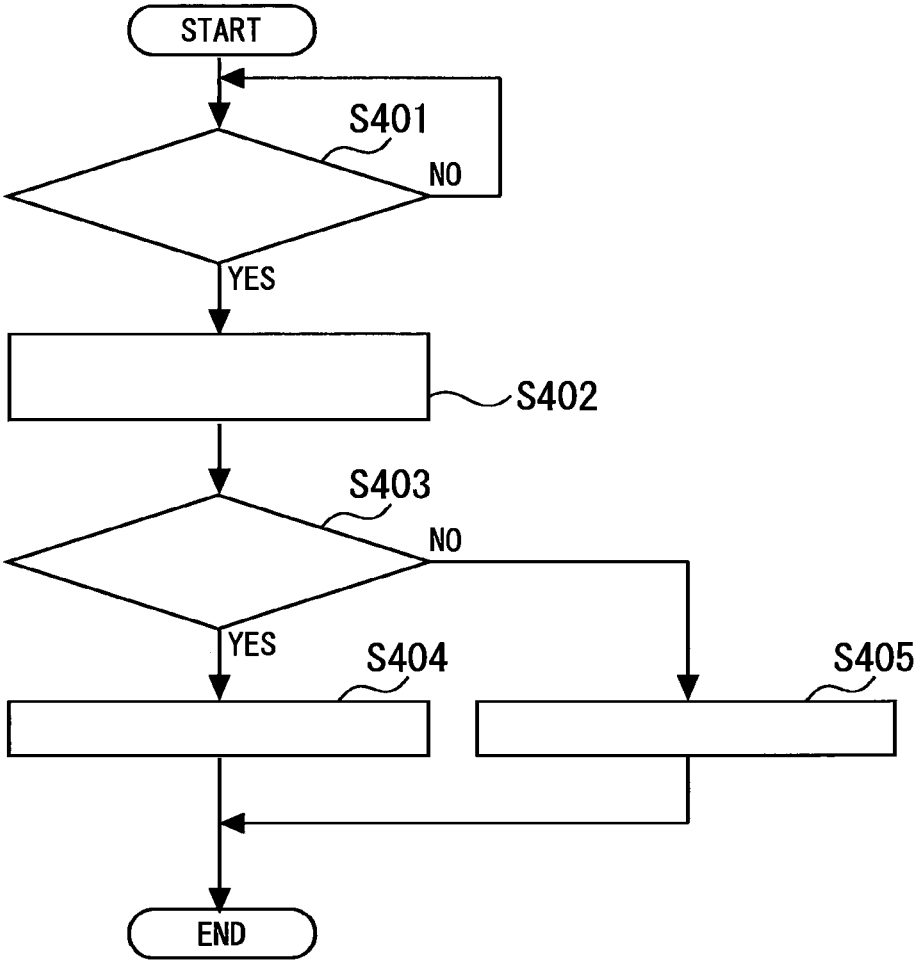
FIG. 6 is a flow chart for illustrating an operation example of an elevator maintenance worker responsible for a remote area.

FIG. 6 is a flow chart for illustrating an operation example of an elevator maintenance worker responsible for a remote area. In a mobile terminal (the device 20) owned by the maintenance worker, a determination is made on whether or not the state data has been received (S401). An elevator device to receive the state data is set in advance for each device 20. A plurality of elevator devices to receive the state data may be set for a single device 20. For example, when the inspection operation is not started in an elevator device A installed in the Kanto area, the state data is transmitted from the elevator device A to a mobile terminal of a maintenance worker B responsible for the Kyushu area.

Upon receiving the state data from an elevator device registered in advance, an owner of the device 20 confirms the received state data. For example, a current state of the elevator is confirmed by viewing information on the car load detected by the load weighing device 17 (S402). When the maintenance worker having confirmed the state data determines that the inspection operation may be started without incident (Yes in S403), the maintenance worker transmits, from the device 20, information to the effect that the start of the inspection operation is to be permitted to the elevator device having transmitted the state data (S404). When the maintenance worker having confirmed the state data determines that starting the inspection operation may pose a problem (No in S403), the maintenance worker transmits, from the device 20, information to the effect that the start of the inspection operation is not to be permitted to the elevator device having transmitted the state data (S405).

The information transmitted from the device 20 in S404 or S405 is received by the reception unit 24 of the communication device 11. The transmission unit 23 has transmitted the state data to a plurality of devices 20 in S307. Therefore, the reception unit 24 receives responses from the plurality of devices 20. On the basis of the plurality of responses from the devices 20 received by the reception unit 24, the determination unit 25 determines whether or not start conditions are satisfied (S308). The start conditions refer to conditions for starting the inspection operation. For example, the determination unit 25 determines that the start conditions are satisfied when information to the effect that the start of the inspection operation is to be permitted is received from all of the devices 20 to which the state data had been transmitted in S307. The determination unit 25 may determine whether or not the start conditions are satisfied on the basis of a proportion or the number of the devices 20 from which information to the effect that the start of the inspection operation is to be permitted is received.

The recovery unit 26 causes the operation control unit 18 to start the inspection operation when the determination unit 25 determines that the start conditions are satisfied (S303).

With an elevator device configured as described above, even when a determination of not starting the inspection operation is automatically made, the inspection operation can be started afterwards on the basis of the determination by a plurality of professional technicians. For example, certain models of elevator devices prevent the inspection operation from being started when a passenger is in the car 1 when an earthquake occurs. When the inspection operation is not started for such a reason, no problem would arise to start the inspection operation if the car 1 becomes vacant and, at the same time, the state data is completely void of abnormalities. Since recovery of the elevator device can be performed when an abnormality is not detected in the inspection operation, the time required for recovery can be reduced. When a major earthquake occurs, it takes time for an elevator maintenance worker to arrive on site. Therefore, the elevator device configured as described above can be effective as means for swift recovery.

Even in the present embodiment, the storage unit 22, the determination unit 25, and the recovery unit 26 may be included in the controller 10.

In the present embodiment, an example has been described in which, when the inspection operation is not started, the state data stored in the storage unit 22 is directly transmitted to a plurality of external devices 20. When the inspection operation is not started, the transmission unit 23 may transmit the state data stored in the storage unit 22 to a specific transmission destination. The transmission destination to which the transmission unit 23 transmits the state data is registered in advance.

The transmission unit 23 transmits the state data in order to have a plurality of professional technicians review the state data collected after the occurrence of an earthquake. Therefore, the state data may become accessible from a plurality of specific devices 20 when the transmission unit 23 transmits the state data to a transmission destination registered in advance. Alternatively, when the transmission unit 23 transmits the state data to a transmission destination registered in advance, the state data may be transferred to the plurality of specific devices 20 from the transmission destination.

The devices 20 from which the state data becomes accessible or the devices 20 to which the state data is transferred are preferably mobile terminals of elevator maintenance workers who are professional technicians. In addition, the devices 20 are preferably mobile terminals of maintenance workers responsible for a remote area. For example, the remote area is desirably an area separated from an installation site of the elevator device by 300 km or more.

The determination unit 25 determines whether or not the start conditions are satisfied on the basis of a plurality of responses from the devices 20 with respect to the state data transmitted by the transmission unit 23. For example, the determination unit 25 determines that the start conditions are satisfied when a determination to the effect that the start of the inspection operation is to be permitted is made by all of the devices 20 registered in advance as devices 20 to confirm the state data. The determination unit 25 may determine whether or not the start conditions are satisfied on the basis of a proportion or the number of the devices 20 having determined that the start of the inspection operation is to be permitted. The recovery unit 26 causes the operation control unit 18 to start the inspection operation when the determination unit 25 determines that the start conditions are satisfied.

By adopting the configuration described above, for example, a social networking service (SNS) or the like can be utilized for the recovery of an elevator device. Functions of an SNS often remain enabled even when an earthquake occurs. Therefore, an SNS becomes effective means when a major earthquake occurs.

INDUSTRIAL APPLICABILITY

The present invention is applicable to an elevator device which performs an inspection operation after an occurrence of an earthquake and to a recovery method of the elevator device.

REFERENCE SIGNS LIST

1 car, 2 shaft, 3 counterweight, 4 main rope, 5 driving sheave, 6 traction machine, 7 machine room, 8 electric motor, 9 braking device, 10 controller, 11 communication device, 12 seismic detector, 13 control cable, 14 display, 15 intercom, 16 camera, 17 load weighing device, 18 operation control unit, 19 inspection unit, 20 device, 21 communication line, 22 storage unit, 23 transmission unit, 24 reception unit, 25 determination unit, 26 recovery unit

The invention claimed is:

1. An elevator device, comprising:

circuitry to perform an inspection operation that collects and analyzes inspection data after detecting an occurrence of an earthquake and after performing an earthquake emergency operation;

interrupt the inspection operation before the inspection operation is completed, when an abnormality is detected by analyzing the collected inspection data;

transmit, when the inspection operation is interrupted, the inspection data collected during the inspection operation to a plurality of specific devices;

determine whether or not recovery conditions are satisfied based on a plurality of responses from the specific devices with respect to the transmitted inspection data, after the inspection operation has been interrupted; and restore a normal operation or cause the inspection operation to be restarted, when the recovery conditions are determined to be satisfied, after the inspection operation has been interrupted.

2. The elevator device according to claim 1, wherein the circuitry is further configured to transmit the inspection data collected during the inspection operation to a transmission destination registered in advance in order to make the inspection data accessible to the specific devices or transmit the inspection data directly to the specific devices.

3. The elevator device according to claim 1, wherein the specific devices are mobile terminals.

4. The elevator device according to claim 3, wherein the circuitry is further configured to transmit the collected inspection data to the specific devices located in an area separated from an installation site of the elevator device by 300 km or more.

5. An elevator device, comprising:

circuitry to start an inspection operation that collects and analyzes inspection data, based on state data, after detecting an occurrence of an earthquake and after performing an earthquake emergency operation;

transmit, when determining that the inspection operation is not started after detecting the occurrence of the earthquake, the state data, which is collected after the occurrence of the earthquake, to a plurality of specific devices;

determine whether or not start conditions are satisfied based on a plurality of responses from the specific devices with respect to the transmitted state data, when the inspection operation has not been started; and cause the inspection operation to be started when the start conditions are determined to be satisfied.

6. The elevator device according to claim 5, wherein the circuitry is further configured to transmit the state data collected after the occurrence of the earthquake to a transmission destination registered in advance in order to make the state data accessible to the specific devices or transfer the state data directly to the specific devices.

7. The elevator device according to claim 5, wherein the devices are mobile terminals.

8. The elevator device according to claim 7, wherein the circuitry is further configured to transmit the collected inspection data to the specific devices located in an area separated from an installation site of the elevator device by 300 km or more.

9. An elevator recovery method, comprising:

performing an inspection operation that collects and analyzes inspection data after an occurrence of an earthquake and after performing an earthquake emergency operation;

interrupting the inspection operation before the inspection operation is completed, when an abnormality is detected by analyzing the collected inspection data;

transmitting, when the inspection operation is interrupted, the inspection data collected during the inspection operation to a plurality of specific devices;

determining whether or not recovery conditions are satisfied based on a plurality of responses from the specific devices with respect to the transmitted inspection data, after the inspection operation has been interrupted; and restoring a normal operation or causing the inspection operation to be restarted, when the recovery conditions are determined to be satisfied, after the inspection operation has been interrupted.

10. The elevator recovery method according to claim 9, wherein the transmitting step comprises transmitting the inspection data collected during the inspection operation to a transmission destination registered in advance in order to make the inspection data accessible to the specific devices or transfer the inspection data directly to the specific devices.

11. The elevator recovery method according to claim 9, wherein the devices are mobile terminals.

12. The elevator recovery method according to claim 11, wherein the transmitting step comprises transmitting the collected inspection data to the specific devices located in an area separated from an installation site of the elevator device by 300 km or more.

13. An elevator recovery method, comprising:

starting an inspection operation that collects and analyzes inspection data based on analyzing state data, after detecting an occurrence of an earthquake and after performing an earthquake emergency operation;

transmitting, when determining that the inspection operation is not started after detecting the occurrence of the earthquake, the state data, which is collected after the occurrence of the earthquake, to a plurality of specific devices;

determining whether or not start conditions are satisfied based on a plurality of responses from the specific devices with respect to the transmitted state data, when the inspection operation has not been started; and starting the inspection operation when the start conditions are determined to be satisfied.

14. The elevator recovery method according to claim 13, wherein the transmitting step comprises transmitting the state data collected after the occurrence of the earthquake to a transmission destination registered in advance in order to make the state data accessible to the specific devices or to transfer the state data directly to specific devices.

15. The elevator recovery method according to claim 13, wherein the devices are mobile terminals.

16. The elevator recovery method according to claim 15, wherein the transmitting step comprises transmitting the collected inspection data to the specific devices located in an area separated from an installation site of the elevator device by 300 km or more.

* * * * *